United States Patent [19]

McGuire

[11] Patent Number: 4,688,365

[45] Date of Patent: Aug. 25, 1987

[54] MODULAR BUILDING BLOCK

[76] Inventor: Daniel S. McGuire, 3991 Old Stone Rd., Oregon, Wis. 53575

[21] Appl. No.: 861,455

[22] Filed: May 9, 1986

[51] Int. Cl.[4] ..... E04B 1/38; E04B 1/62

[52] U.S. Cl. ..... 52/593; 52/405; 446/112

[58] Field of Search ..... 52/405, 580, 594, 593, 52/588, 578; 446/112, 113

[56] References Cited

U.S. PATENT DOCUMENTS

| | | | |
|---|---|---|---|
| 1,604,391 | 10/1926 | Croy | 52/594 |
| 2,173,020 | 9/1939 | Kubach | 52/594 |
| 2,199,112 | 4/1940 | O'Leary | 52/405 |
| 2,228,363 | 6/1941 | Pinney | 52/580 |
| 3,438,165 | 4/1969 | Morawski | 52/594 |
| 3,665,669 | 5/1972 | Huber | 52/594 |
| 3,722,157 | 3/1973 | Prokop | 52/580 |
| 4,608,799 | 9/1986 | Hasegawa | 446/112 X |

FOREIGN PATENT DOCUMENTS

| | | | |
|---|---|---|---|
| 1118541 | 7/1968 | United Kingdom | 52/593 |

*Primary Examiner*—J. Karl Bell

*Attorney, Agent, or Firm*—Warren D. Flackbert

[57] ABSTRACT

A modular building block characterized by a male-female fastener arrangement between successive layers of blocks, i.e. the blocks are positively positioned by a pattern of locking tabs cooperating with slots. Each modular building block is compartmentalized for receiving insulative material and space for utility passage. Provision is made for readily securing the modular blocks onto a conventional footing and/or foundation. Corners and block staggering between successive layers are effectively achieved through choosing the appropriate pattern presented by the aforesaid male-female fastener arrangement. The modular building blocks are rigid, yet light in weight, due to fabrication material selection.

6 Claims, 3 Drawing Figures

Figures 1, 2, 3:
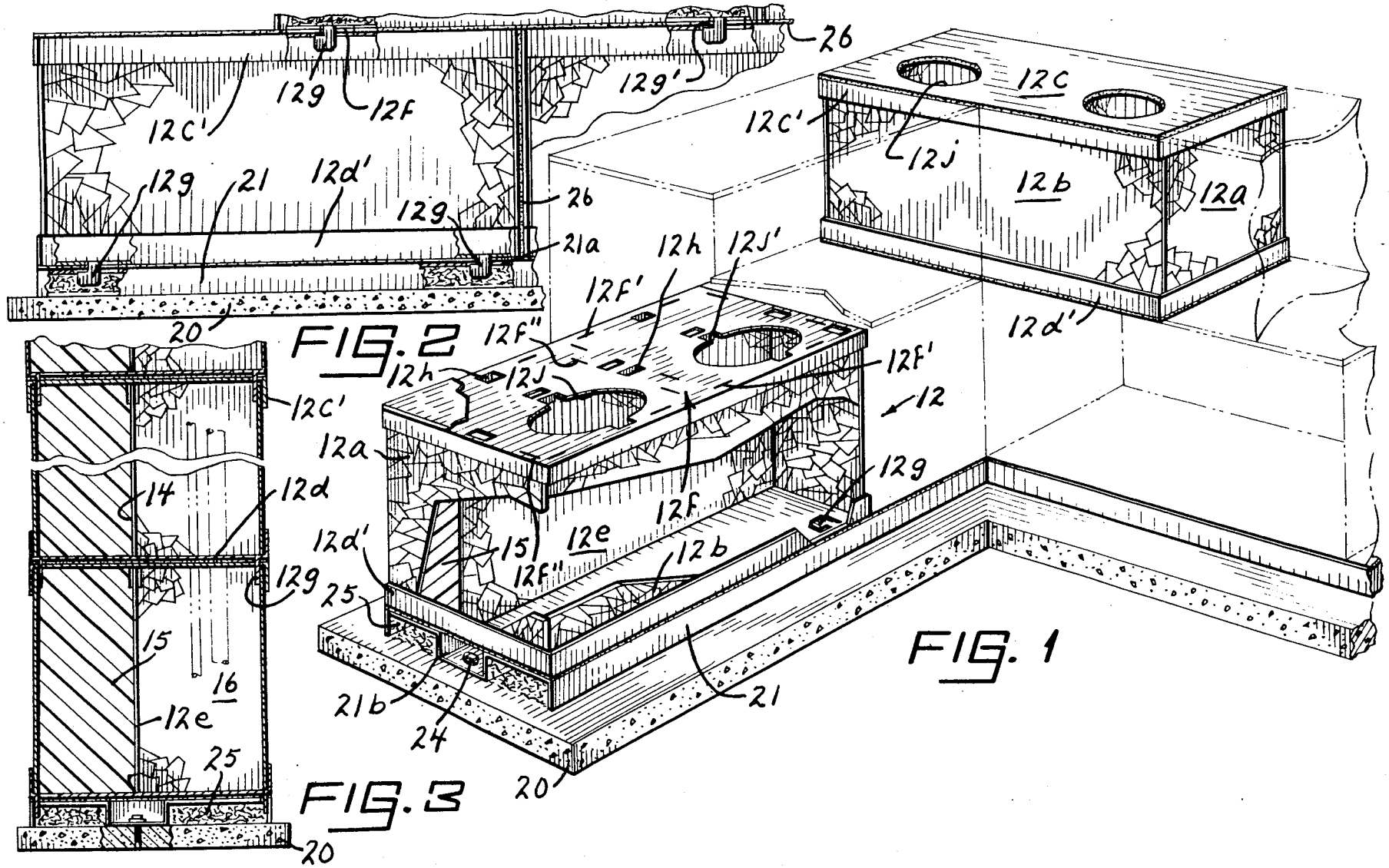

12a
12b
12c
12d'
12j
12c'
26
129'
12j'
12h
12f'
12f''
12
129
12e
15
21
20
24
21b
25
12d'
12a
12c'
12d
16
14
21a
129
12f
12d'
21
12c'
129
20

MODULAR BUILDING BLOCK

As is known, the usage of standard concrete blocks is widespread in the building trades, such typically defining walls, partitions, foundations or the like. Objections to concrete block usage, however, include the awkwardness of such during placement, primarily by reason of weight; the cost of shipping from the manufacturing site to the use site; the time involved for installation, including the need for mortar; and, the inability for reuse or, at least, the difficulty for reuse, if desired.

The invention presents a modular building block which is light in weight and readily installed without the need for a particular skill, requiring only tab fastening, i.e. no mortar, glue, nails, screws or the like for on site placement. The instant modular block affords effective insulative characteristics, and with the optional use of foam sheeting between the blocks, weatherproofing is even further implemented. Moreover, each modular block includes openings which permit the passage of electrical, plumbing or other conduits required to complete a building installation.

More specifically, the modular building block presented by the invention is installed through the use of cooperating male-female fasteners in the form of locking tabs and slots, where the locking tab receiving female fasteners are arranged in a pattern on the top wall or surface of the block which permits block staggering from row to row and, as well, the ability to place the blocks either in-line or normal with respect to each other. The latter serves to effectively achieve a corner. Once a foundation plate has been established, the assembly of the instant modular blocks is rapidly accomplished to satisfy any building requirement which formerly utilized a structural concrete block.

Moreover, the instant modular building block is light in weight, yet strong and rigid, because of the preferred overall assembly thereof from wafer or chip board and sheet metal stock.

In any event, a better understanding of the present invention will become more apparent from the following description, taken in conjunction with the accompanying drawing, wherein FIG. 1 is a perspective view showing a typical installation of modular building blocks made in accordance with the teachings of the present invention;

FIG. 2 is a view in side elevation of the instant modular building block, partly broken away to detail installation with respect to an adjoining foundation plate and the next above layer of blocks; and, FIG. 3 is a view in end elevation further detailing the invention, typically looking from left to right in FIG. 2.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, modular building block 12 of the invention, corresponding in size to a conventional concrete block,is defined by end walls 12*a*, side walls 12*b*, a top wall 12*c* and a bottom wall 12*d*. In a preferred invention embodiment, the end walls 12*a* and the side walls 12*b* are made from wafer or chip board, while the top wall 12*c* and bottom wall 12*d* are each made from sheet metal, both of the latter including a depending flange 12*c'* and 12*d'* (see the lower left hand portion of FIG. 1).

Each modular building block 12 includes an inner wall 12*e*, also typically made from wafer or chip board, defining compartments 14 and 16. Compartment 14, generally facing towards the outside of a structure (if the building blocks define an outer wall), receives a commercially available insulation material 15, where compartment 16 provides space within which conduits, as for electricity, water or the like (shown in phantom in FIG. 3) may pass.

Aside from stability and lightness of weight, an important feature of the instant modular building block 12 is the ease of assembly and installation. In this connection, a series of male-female fasteners are employed, being represented by slots 12*f* and bendable locking tabs 12*g*, where the latter are arranged in a defined pattern on the bottom wall 12*d* of each block and movable from an in-plane non-use or transporting position to an extended use position (see FIGS. 1 and 2). The top and bottom walls 12*c*–12*d* further include bendable tabs 12*h* for positioning, in an operative condition, end walls 12*a*, side walls 12*b*, and inner wall 12*e* (see FIGS. 1 and 3 as to the inner wall 12*e*, but not detailed or completely detailed as to the end walls 12*a* and the bottom wall 12*d*).

As particularly evident in FIG. 1, the top wall 12*c* of each block typically presents enlarged openings 12*j* (in any desired configuration) to permit passage of electrical, plumbing or like conduits (shown in phantom in FIG. 3). Portions of the enlarged openings 12*j* may also include bendable tabs 12*j'* for inner wall 12*e* and an adjacent side wall 12*b* positioning.

In any event, the arrangement of slots 12*f* is critical to placement and orientation of the respective rows and/or layers of modular blocks 12, i.e. with respect to a running wall or at corners. In other words, slots 12*f* typically are oppositely disposed pairs parallel with the longitudinal axis of block 12 and proximate the edges of the top wall 12*c*, while slots *f'* are laterally disposed with respect to the aforesaid longitudinal axis, also in oppositely disposed pairs, but geometrically arranged within spacing which represents the width of block 12.

As particularly shown in FIG. 2, the locking tabs 12*g* include a cut-out portion 12*g'*, which serves for positive engagement. Restated otherwise, a locking tab 12*g* is inserted into a cooperating slot 12*f* and then moved or pushed forwardly so that the cut-out portion 12*g'* is overlaid by the top wall 12*c* of the block 12 in a secure retaining relationship.

In order to accomplish the initial or first layer of block placement, and after the footing or foundation 20 is established, a foundation plate 21 is secured thereto by bolt-washer combinations 24 which are received in slots 21*a* defined in an indented longitudinal or central portion 21*b* of the foundation plate 21 (see FIG. 2). The space remaining beneath the foundation plate 21 is filled with insulative material 25.

Thereafter, as each foundation plate 21 has the same slot 12*f* configuration as that in the top wall 12*c* of each of the blocks 12, assembly is readily accomplished through locking tab 12*g* placement within a cooperating slot 12*f* and, thereafter, pushed to achieve a locked effect with respect to the foundation plate 21 or the top wall 12*c* of the next adjoining and above block 12.

In order to achieve an effective seal for added weatherproofing, and also increased tension for even more positive installation, a layer of insulative foam 26 may be utilized between adjacent surfaces of blocks, i.e. between the end walls 12*a* of each and/or between the next above row of modular blocks 12.

The invention permits the ready erection of a wall or the like without the disadvantages associated with the usage of a commonly known concrete block. The arrangement is such that the modular blocks in successive layers can be staggered with respect to each other (see FIG. 2) and/or disposed laterally to achieve a corner (see FIG. 1). The preceding is by reason of slot 12*f* (12'-12*f*'') directional placement on the top wall 12*c* of each block 12, i.e. and as stated, longitudinally and laterally.

It should be evident, therefore, that the instant modular building block adds a new dimension for convenience and effectiveness, without sacrificing utility, for the building trades. The modular block described herein is susceptible to various changes within the spirit of the invention, as in dimensioning, precise slot(s) and tab(s) location(s), compartment sizes, and the like. Thus, the preceding should be considered illustrative and not as limiting the scope of the following claims:

I claim:

1. A modular building block comprising an enclosure defined by end walls, side walls, a top wall and a bottom wall in an assembled relationship, said top wall including a pattern of fastener slots and said bottom wall including fastener tabs selectively slidable into a cooperable locking relationship in both vertical and horizontal directions with fastener slots in the top wall of another enclosure therebelow, where certain of said fastener slots in said top wall are disposed parallel to the longitudinal axis and along opposite edges thereof adjacent each of said side walls of said enclosure and other of said fastener slots are normal to said longitudinal axis at the mid-region of said enclosure and along an edge thereof adjacent each of said end walls of said enclosure, and where said fastener tabs each include a cut-out portion overlaid by the top wall of said another enclosure at an assembled condition.

2. The modular building block of claim 1 where said fastener tabs are bendable from an in-plane position with said bottom wall in a non-operative condition to an extended condition with respect to said bottom wall in a use condition.

3. The modular building block of claim 1 where said other of said fastener slots arrange one enclosure at a right angle to another lower enclosure.

4. The modular building block of claim 1 where the selective choice of fastener slots affords both an in-line and a staggered relationship between layers of enclosures.

5. The modular building block of claim 1 where said certain of said fastener slots are in an opposing paired position along opposite side edges of said top wall of said enclosure, and where said other of said fastener slots are in an opposing paired position along end edges of said top wall and along spaced apart generally parallel lines at said mid-region of said enclosure normal to said longitudinal axis of the latter.

6. The modular building block of claim 1 where a layer of insulative foam between end, bottom and top walls of adjacent enclosures serves added tension and an increased locking relationship between said fastener slots and said fastener tabs.

* * * * *